US008560240B2

(12) United States Patent
Willden et al.

(10) Patent No.: US 8,560,240 B2
(45) Date of Patent: Oct. 15, 2013

(54) SENSOR NETWORK FOR DETECTING RIVERBED SCOUR

(75) Inventors: Gregory C. Willden, San Antonio, TX (US); Donald R. Poole, Jr., San Antonio, TX (US); Ben A. Abbott, San Antonio, TX (US); Ronald T. Green, Helotes, TX (US)

(73) Assignee: Southwest Research Institute, San Antonio, TX (US)

( * ) Notice: Subject to any disclaimer, the term of this patent is extended or adjusted under 35 U.S.C. 154(b) by 348 days.

(21) Appl. No.: 13/041,408

(22) Filed: Mar. 6, 2011

(65) Prior Publication Data

US 2012/0226441 A1 Sep. 6, 2012

(51) Int. Cl.
*G06F 19/00* (2011.01)

(52) U.S. Cl.
USPC ..... 702/2

(58) Field of Classification Search
USPC ..... 702/2
See application file for complete search history.

(56) References Cited

U.S. PATENT DOCUMENTS

2011/0093139 A1* 4/2011 Arms et al. ..... 701/2

* cited by examiner

*Primary Examiner* — Bryan Bui
(74) *Attorney, Agent, or Firm* — Chowdhury & Georgakis PC; Ann C. Livingston

(57) ABSTRACT

A riverbed scour detection system, comprising a wireless sensor network embedded in areas of potential scour. The scour detection network has one or more vertical stacks of sensor nodes placed in the riverbed at known locations. The sensors detect each other, and non detection of a sensor indicates its removal by scour activity.

18 Claims, 4 Drawing Sheets

SENSOR NETWORK FOR DETECTING RIVERBED SCOUR

TECHNICAL FIELD OF THE INVENTION

This invention relates to a network of sensors especially arranged to detect riverbed scour.

BACKGROUND OF THE INVENTION

Approximately 80 percent of highway bridges in the United States pass over creeks, rivers, and streams. A common threat to these bridges is scour, which undermines the integrity of bridge piers and abutments.

Scour is especially threatening during floods and other periods of extreme river flow activities. During such activities, erosion of the foundation materials below the bridge piers causes structural instability. This process can be very dynamic, with erosion taking place near the peak flow rates and deposition of sediments occurring during descending stages of the flood.

If scour is not identified in time, the structural integrity of the bridge can progressively deteriorate. Development of a simple, reliable, and cost-effective scour monitoring system could have a tremendous impact on bridge safety.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION OF THE INVENTION

The following description is directed to a scour detection system, comprising a wireless sensor network embedded in areas of potential scour. Examples of suitable locations are in riverbeds near bridge piers and abutments. "Scour" is used herein in the broadest sense to mean water erosion at the base of a structure; scour detrimental to bridges, piers and other structures could occur at locations other than riverbeds, such as at lakes and oceans.

The scour detection network has one or more vertical stacks of sensors placed in the riverbed at known locations. A feature of the invention is that the sensors need detect only each other, and need not detect environmental conditions per se. If sensor is missing from the stack, it is not detected by other sensors, and can be assumed to have been washed away by scour activity.

Figure 1:
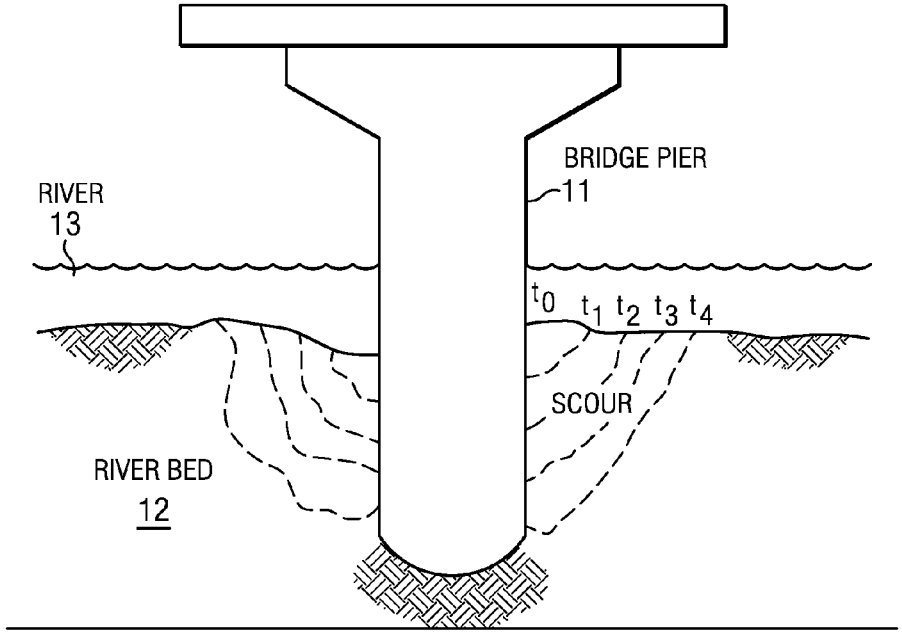
FIG. 1 illustrates a bridge pier located in a riverbed under a river.

FIG. 1 illustrates a bridge pier 11 located in a riverbed 12 under a river 13. As illustrated by the dotted lines, over time ($t_0$-$t_4$), scour has developed next to the bridge pier 11. This scour development could be over long period of time or could occur relatively quickly, such as during a storm flow event.

Figure 2:
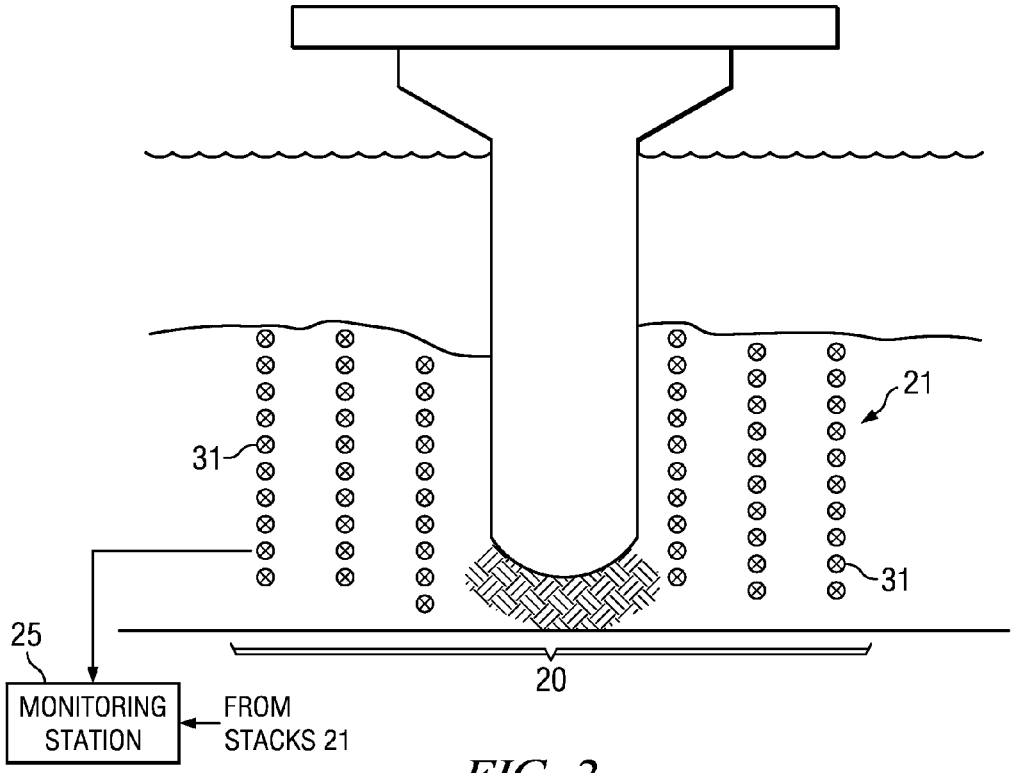
FIG. 2 illustrates a scour monitoring sensor network 20 installed near the bridge pier, prior to occurrence of scour.

FIG. 2 illustrates, at time $t_0$, a scour monitoring sensor network 20 installed near the bridge pier 11. In the example of FIG. 2, sensor network 20 has six vertical sensor stacks 21. Each stack 21 has a number of sensors 31 placed one on top of the other with a substantially even spacing. At this time, there has been no erosion, and each stack 21 has all its sensors 31 in place. As explained below, as a result of scour, one or more sensors may be washed away.

The sensors 31 of a particular stack need not be attached to each other in any way. They may be simply buried in the riverbed and held in place by the riverbed material. However, in some embodiments, for convenience of installation, the sensors of a stack may be held in position by breakable or dissolvable connection material, which would allow sensors to wash away during flood events. Examples of suitable connectors are environmentally degradable tubes or wires.

A monitoring station 25 is in data communication with at least one sensor 31 in each stack 21. As explained below, at predetermined intervals or at event-driven occasions, the stack 21 (via one or more of its sensors 31) delivers data (or data in the form of an analog signal) to the monitoring station 25 that represents the identifications of all sensors presently in that stack. The monitoring station 25 may be proximate the bridge pier 11 to minimize the communication effort required from the stacks 21. If proximate to pier 11, the monitoring station 25 may further communicate with a more remote base station.

Figure 3:
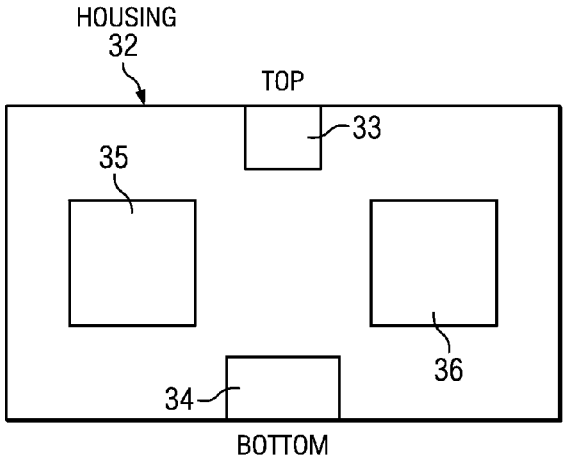
FIG. 3 is a block diagram of one embodiment of a single sensor in the network of FIG. 2.

FIG. 3 is a block diagram of one embodiment of a single sensor 31. As illustrated, each sensor 31 has a top side and a bottom side, such that when the sensors are placed in a stack, the bottom side of the top sensor is vertically aligned with the top side of the next sensor, etc. As explained below, the spacing between sensors is largely a design choice, and may be affected by the type of sensor-to-sensor detection used and the riverbed material.

A housing 32 protects the internal circuitry from environmental damage. For example, a typical housing 32 is both waterproof and rigid.

Each sensor 31 has two wireless communications ports: an upper communications port 33 and a lower communications port 34. As explained below, these ports allow sensor 31 to deliver its identification signal to its neighboring sensor in its stack and to receive an identification signal from its other neighboring sensor. Also, at least one of these ports may be used to communicate with monitoring station 25 (directly or via other sensors in the stack).

In the example of this description, the wireless communications are line-of-sight infrared (I/R) communications. A simple series of I/R pulses can be used to communicate a sensor's identification to a neighboring sensor. If a sensor is missing, no identification signal is received by a neighboring sensor, and that sensor (directly or via another sensor) can communicate that information to the monitoring station 25.

In other embodiments, the detection of neighboring sensors by a sensor, or communication of detection results, can be performed with other wireless communication types, such as by other types of optical, sonar or radio frequency communications. As described below, the detection of neighboring sensors and the communication of detection data to monitoring station (directly or via other sensors) need not be by the same communications media.

A low power processor 35 has appropriate hardware and software for performing the tasks described herein and for storing appropriate data and programming. An example of a suitable processor is a MSP430 processor, commercially available from Texas Instruments.

The power supply circuitry comprises a small battery 36. An example of a suitable battery is a button-cell battery.

Each sensor 31 has a unique signature. For example, in the case of infrared sensor detection, the signature could be a simple series of pulses. This signature represents unique identification data for that sensor. Each sensor 31 is accurately located when emplaced in the riverbed. Thus, monitoring station 25 can access location data for any sensor and determine the location of that sensor in a particular stack.

Referring again to FIG. 2, in each stack 21, the sensors 31 are arranged such that each sensor's upper IR port 33 is aligned with the lower IR port 34 of the sensor above it. The processor 35 of each sensor is able to use its two IR ports 33 and 34 to communicate with the sensors above and below it in the stack.

In a typical implementation, sensors 31 are programmed so that a "lead" sensor initiates a count of sensors in its stack. Each sensor adds to the count by acknowledging a communication from the sensor above it. If no acknowledgement is received, it can be assumed that the sensor and any sensors above it are missing. If a "lead" sensor is designated, it would typically be the bottom sensor of a stack, and detection data would be sent "downstream" to the lead sensor, which then communicates with the monitoring station.

Communications with monitoring station 25 could be by a variety of alternatives. Each sensor could communicate with monitoring station. Alternatively, a "lead" sensor in a stack could collect information from all sensors in the stack and then communicate with the monitoring station.

Figure 4:
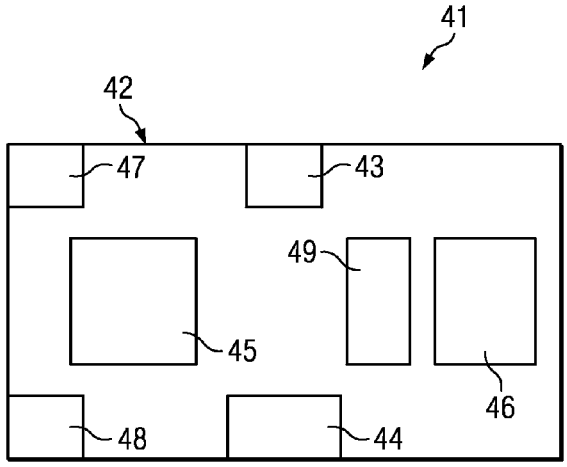
FIG. 4 illustrates an alternative embodiment of a sensor, which has sonar transducers for enhancing the low power features of the sensor.

FIG. 4 illustrates an alternative embodiment, a sensor 41 having sonar transducers for enhancing the low power features of each sensor. The housing 42, upper and lower I/R ports 43 and 44, processor 45, and battery 46 are similar to the corresponding elements of sensor 31.

Each sensor 41 also has two sonar transducers: an upper sonar transducer 47 and a lower sonar transducer 48. These transducers may be used in a "sonar transduction" mode, such that a sensor could help power the sensor above or below it. Each sensor would then be equipped with a large capacitor 49 connected to battery 46.

Although not explicitly shown in FIGS. 3 and 4, the communications ports (I/R and sonar) may have related circuitry for providing an interface to processor 45. For example, a transceiver may provide send and receive functionality to the transducers 47 and 48 of FIG. 4.

Figure 5:
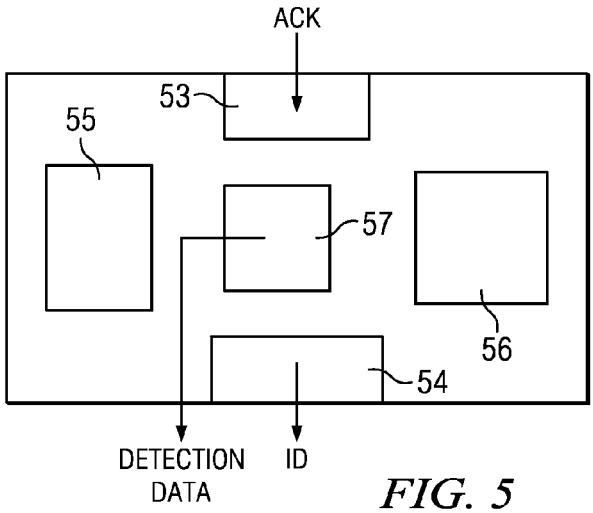
FIG. 5 illustrates another alternative embodiment of a sensor.

FIG. 5 illustrates another embodiment of sensors to be used in stack 21. In this embodiment, the communications used for sending and receiving identification signals between neighboring sensors is via upper and lower ports 53 and 54, but a third communications port 57 is used for generating communication of detection data to other sensors or to the monitoring station. Various combinations of I/R, sonar, and RF communications could be used. Processor 55 and battery 56 are as described above.

FIG. 5 further illustrates how each sensor's lower communications port 54 emits an ID signal and the upper communications port 53 receives the ID signal of its neighboring sensor. The receiving sensor then generates an acknowledgement (detection signal) which can then be transmitted downstream, directly to a lead sensor, or directly to the monitoring station. This detection signal is the basis for detection data, which represents which if any of the sensors are missing.

In this embodiment, a third port is used to send detection data to another sensor (or sensors) or to the monitoring station 25. In the embodiment of FIG. 2, this task is performed by the upper or lower communication ports. Lack of an acknowledgement indicates a missing sensor, and because the sensor's location is known, the location of the scour activity is known.

As stated above, at pre-determined or event-driven intervals, a designated sensor 31 in a stack 21 initiates a round of counting whereby the number of sensors in that stack is determined. This number, representing the height of the stack, is communicated to the monitoring station 25. Typically, the counting sensor 31 is the bottom sensor of a stack 21, and is also the sensor that communicates with monitoring station 25. In this case, the communications between the bottom sensor and the monitoring station 25 could be wired communications.

Figure 6:
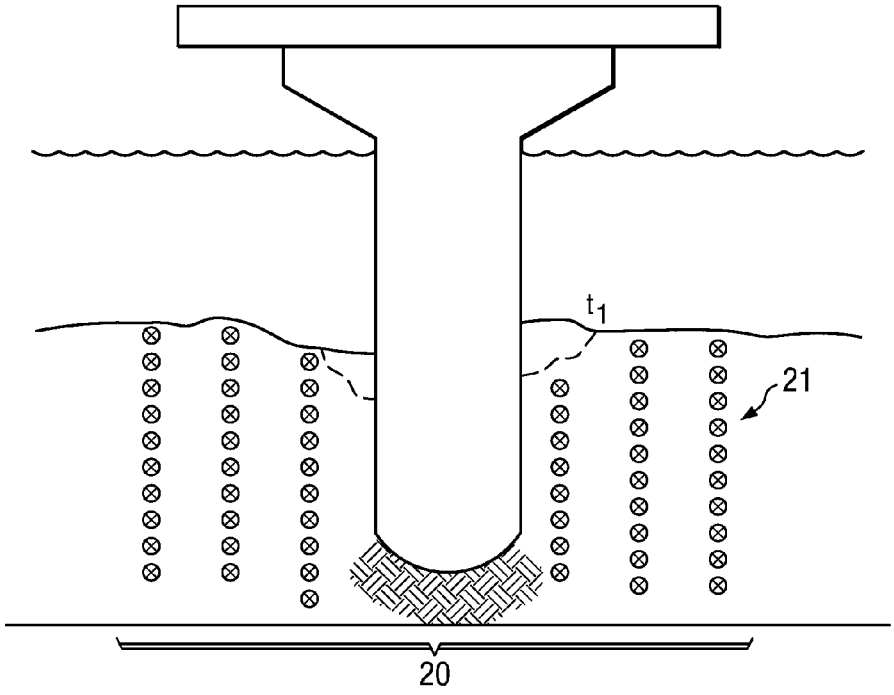
FIG. 6 illustrates the riverbed after scour activity.

FIG. 6 illustrates the riverbed at time $t_1$, at the beginning of scour activity. One of the sensor stacks 21 has lost its top two sensors 31. These sensors 31 have washed away, and are no longer in communication with the stack 21.

Figure 7:
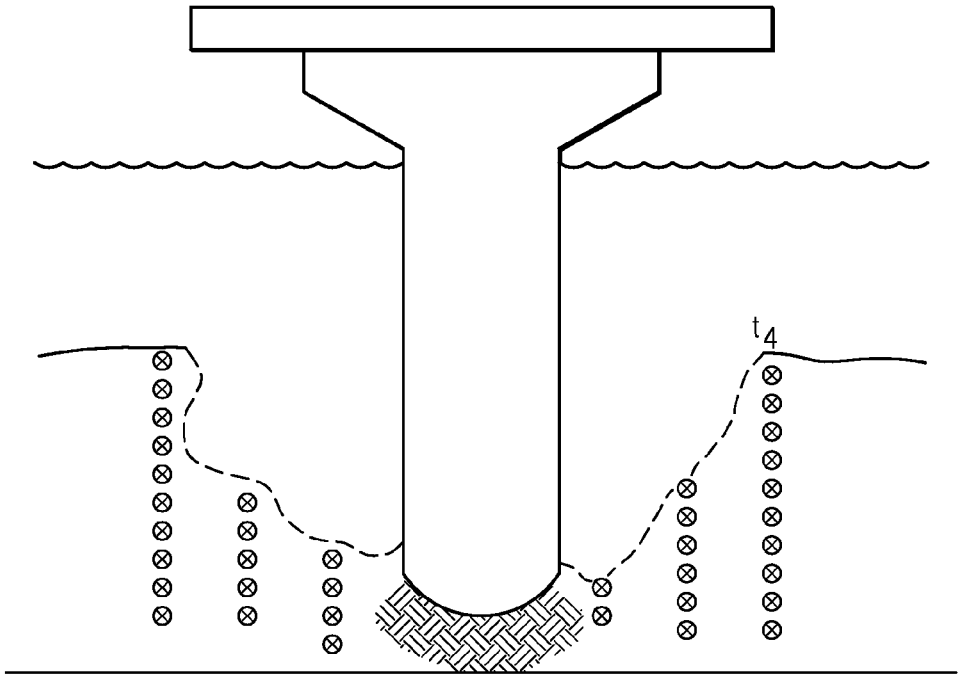
FIG. 7 illustrates the riverbed after additional scour activity.

As illustrated in FIG. 7, over time, scour may continue to wash away more sensors. At time $t_4$ four of the original six stacks are missing sensors.

Figure 8:
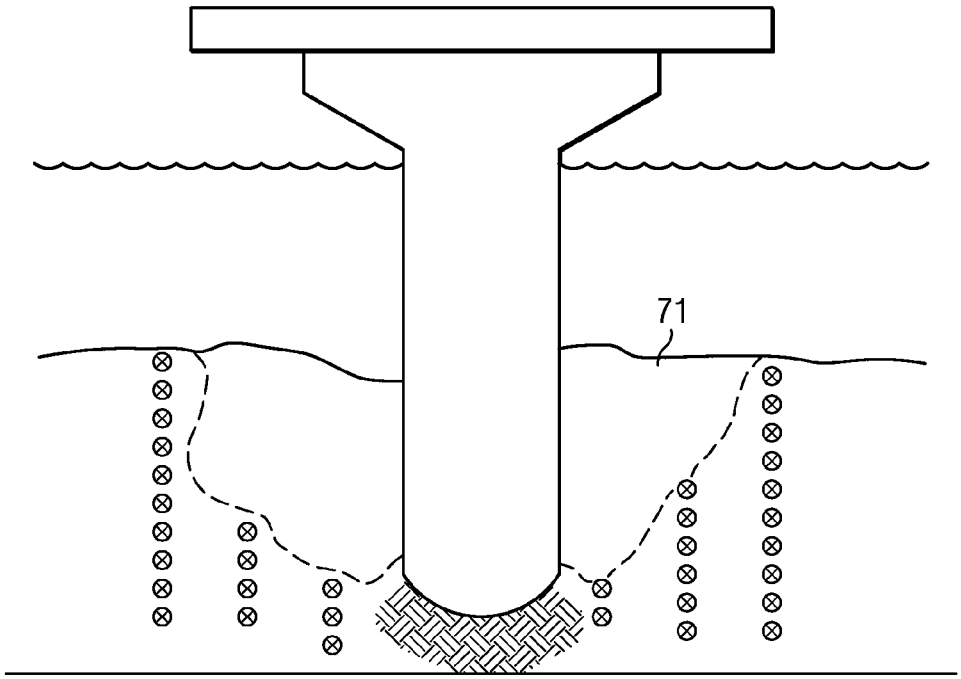
FIG. 8 illustrates the riverbed after scoured regions have refilled with sediment and are again covered with river water.

In FIG. 8, the scoured regions have refilled with sediment 71, and are again covered with river water.

A feature of the invention is that, for any sensor stack 21, the remaining sensor nodes detect the removal of any one or more overlying sensors. The detection occurs for removal of one or many sensors, such as in FIGS. 6 and 7, as well as if the scoured regions refill with sediment as in FIG. 8.

If a sensor is removed by scour or other riverbed activity, one or more sensors that are still in place in the riverbed are alerted. This sensor sends a signal to the monitoring station 25 with the unique signature of departed node. Removal of a sensor permits detection of scour that might otherwise go undetected in those cases when the scoured cavity is refilled with sediment when the river recedes to normal flow conditions, such as in FIG. 7.

The number of sensors per stack and the number of stacks is arbitrary, and in theory, even a single stack with two sensors could be useful. However, emplacement of multiple sensor nodes in multiple stacks enables the full depth and extent of scour to be detected.

What is claimed is:

1. A sensor system for detecting scour, comprising:

at least one stack of sensors arranged vertically, one on top of the other;

wherein each sensor has at least the following elements: a processing unit, a first communications port on one side of the sensor, and a second communications port on the opposing side of the sensor;

wherein the sensors are configured to use the first communications port to emit an outgoing signal representing an identification of that sensor, to use the second communications port to detect an incoming signal representing the identification of a neighboring sensor, and to transmit a detection signal representing detection or non detection of the neighboring sensor; and a monitoring station operable to receive one or more monitoring signals from one or more of the sensors after the sensors are placed in an environment in which scour may occur, and to interpret the one or more monitoring signals to determine if one or more of the sensors are missing.

2. The system of claim 1, wherein the first and second communications ports are optical communications ports.

3. The system of claim 1, wherein the first and second communications ports are sonar communications ports.

4. The system of claim 1, wherein the first and second communications ports are radio frequency communications ports.

5. The system of claim 1, wherein the sensors are vertically connected with a breakable or dissolvable connector.

6. The system of claim 1, wherein the detection signal is transmitted via the first or second communications port.

7. The system of claim 1, wherein the detection signal is a count of sensors in the stack.

8. The system of claim 1, wherein each sensor further has a first sonar transducer and a second sonar transducer, on opposing sides of the sensor, configured to produce sonar induction energy.

9. The system of claim 1, wherein each sensor has a battery for providing power to the sensor.

10. A method of detecting scour, comprising:

arranging at least one stack of sensors vertically, one on top of the other, in an environment in which scour may occur;

wherein each sensor has at least the following elements: a processing unit, a first communications port on one side of the sensor, and a second communications port on the opposing side of the sensor;

wherein the sensors are configured to use the first communications port to emit an outgoing signal representing an identification of that sensor, to use the second communications port to detect an incoming signal representing the identification of a neighboring sensor, and to transmit a detection signal representing detection or non detection of the neighboring sensor;

receiving a monitoring signal from one or more of the sensors representing a number of sensors, or identification of sensors, currently present in the stack of sensors; and interpreting the monitoring signal to determine if one or more of the sensors are missing from the stack of sensors.

11. The method of claim 10, wherein the sensors emit and detect each other at pre-determined intervals.

12. The method of claim 10, wherein the sensors emit and detect each other in response to a triggering event.

13. The method of claim 10, wherein the first and second communications ports are optical communications ports.

14. The method of claim 10, wherein the first and second communications ports are sonar communications ports.

15. The method of claim 10, wherein the first and second communications ports are radio frequency communications ports.

16. The method of claim 10, wherein the detection signal is a count of sensors in the stack.

17. The method of claim 10, wherein each sensor further has a first sonar transducer and a second sonar transducer, on opposing sides of the sensor, configured to produce sonar induction energy.

18. The method of claim 10, wherein each sensor has a battery for providing power to the sensor.

* * * * *